United States Patent [19]

Stoughton et al.

[11] Patent Number: 4,531,826

[45] Date of Patent: Jul. 30, 1985

[54] EVENT COUNTER AND ACCESS CONTROLLER

[75] Inventors: Alan M. Stoughton, Vincentown; Charles C. Hansen, Sr., Marlton; John P. Leahy, Mount Laurel; Robert F. Millar, Lindenwold, all of N.J.

[73] Assignee: Danyl Corporation, Moorestown, N.J.

[21] Appl. No.: 373,675

[22] Filed: Apr. 30, 1982

[51] Int. Cl.[3] ..... G03G 15/00

[52] U.S. Cl. ..... 355/14 CU; 377/16

[58] Field of Search ..... 377/8, 15, 16; 355/14 CU; 235/382

[56] References Cited

U.S. PATENT DOCUMENTS 3,427,441 2/1969 Swords ..... 355/14 CU 4,249,163 2/1981 Maurer et al. ..... 235/381

*Primary Examiner*—R. L. Moses

*Assistant Examiner*—David Warren

*Attorney, Agent, or Firm*—Ratner & Prestia

[57] ABSTRACT

An event counter and access controller system has a central processor unit, memory storage, and operator's keyboard, display, badge reader and key switch. The system may operate in a normal mode, wherein copy pulses from a photocopier, for example, are counted and stored in individual user accounts; and in a set-up mode, wherein accounts may be sorted and examined, may be made accessible or inaccessible, and may have their contents changed. When receiving count copy pulses from an event to be counted, the system certifies the validity of the pulses by filtering and sampling techniques. When an access card is inserted in the badge reader, the system validates and accounts for skew tolerance of the card.

10 Claims, 13 Drawing Figures

141

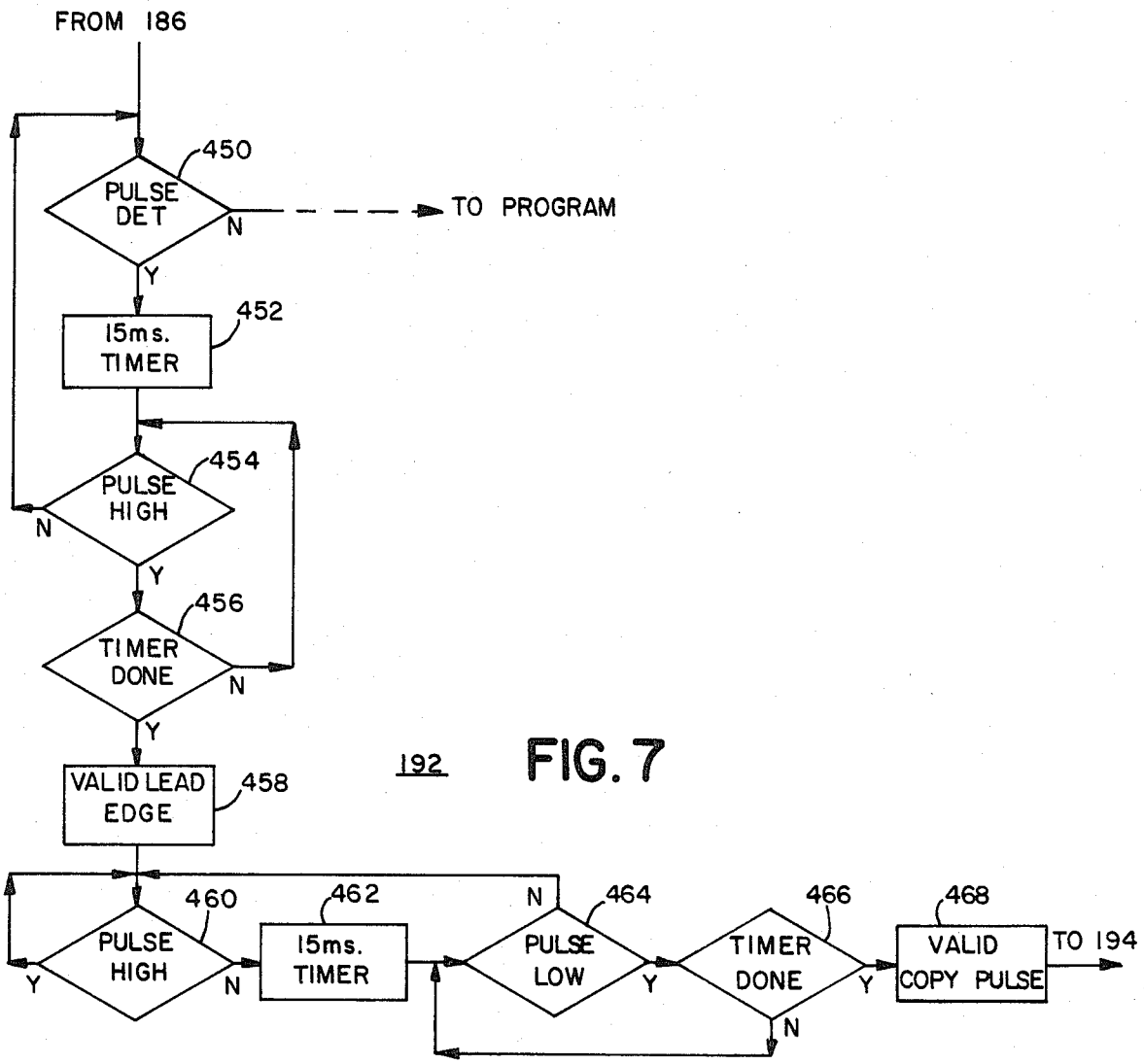
FIG. 7
FIG. 8
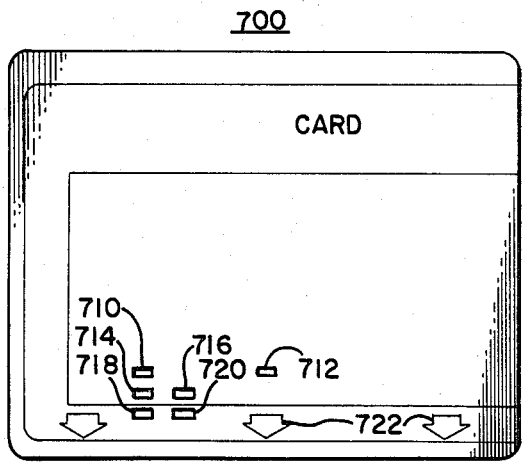

EVENT COUNTER AND ACCESS CONTROLLER

TABLE OF CONTENTS

Abstract
Background of the Invention
A. Field of Invention
B. Background Art
Summary
Brief Description of the Drawings
Description of the Illustrative Embodiment
General Description
Power Down Circuit
CPU Program Description
Badge Operation
Copy Pulse Certification

BACKGROUND OF THE INVENTION

A. Field of the Invention

This invention relates generally to access control systems for counting events and more specifically to photocopy counters and access controllers.

B. Background Art

Photocopies have become a major factor in office overhead costs. With increased speed in copiers today, numerous copies may be made by any user having access to a copier. Since such access is not controlled, copying expenses may multiply rapidly. Furthermore, if many users are permitted access to the copier, an accounting of how many copies are made by each user is difficult, if not impossible.

Prior systems have been developed to prevent unauthorized users from gaining access to the copier and also count the number of copies made by each user. One such prior system is System 80 Transaction Recorder, manufactured by Danyl Corporation, Pennsauken, N.J., the assignee of this application.

In order to count the number of copies made by the user, these prior systems rely on a copy pulse outputted from the photocopier. Such pulse is present whenever a photocopy is made by the machine. By counting the number of copy pulses present, the prior systems determine the number of copies made. The prior systems, however, leave much to be desired. Since each photocopier generates unique copy pulse characteristics, each of the prior systems has to be specially configured to interface with the idiosyncracies of the photocopier. Such task is complicated since copy pulses vary in amplitude and duration from one copier to another. Moreover, prior systems are susceptible to the presence of noise on the copy pulse lines, thereby erroneously counting pulses.

Prior systems also have the ability to prevent unauthorized users from accessing the photocopier. Users are prevented from accessing the copier by the use of badge reader devices or personal account number verification devices. Unless a user has a valid badge or an authorized account number, access is denied. Here too, prior systems leave much to be desired. Badge reader devices have been known to be inaccurate, sometimes having problems identifying a particular badge. Also, account number verification devices have proven to be cumbersome to update, being difficult to modify old account numbers or add new account numbers.

In addition, it has been difficult to examine each individual account number and view its current copy status. The user has had difficulty in determining how many copies he has made and how many more are allotted to him. Also, if the user exceeded his copy count limit, the controller disabled the copier in the midst of the transaction, thereby sometimes jamming the copier.

During set-up conditions, whereby the user initializes, denies or permits access to an account, changes copy count limits, etc., the menu to perform various functions has also been inadequate. For example, it has not been possible to examine accounts at random or sort it for sequential examination.

Yet another deficiency has been the inadequate protection given to the guarding of memory in the controller system. Since it is desirable to maintain account status in a random access memory (RAM) for as long as a month, protection of the RAM is paramount. Prior systems have been known to inadvertently destroy RAM memory during processor failure.

Prior photocopy control systems also exist which have a microcomputer that interacts with peripheral devices, such as a keyboard, a display or a badge reader. However, these systems required cumbersome interfaces so that the microcomputer could communicate with these peripherals. Communications was thus slow and inefficient.

It is, therefore, an object of this invention to improve on all of the above deficiencies and obtain a much better photocopy controller.

SUMMARY OF THE INVENTION

An event counter and access controller system having a central processing unit, a memory storage unit and an operator's display and keyboard. The system has three modes of operation: (1) a normal operating mode, (2) a set-up mode and (3) a local mode. In the set-up mode a machine access code is selected for a first verification of the access of the user. There is further selected an individual indentification of each of a plurality of accounts each corresponding to a different user. Each account has a corresponding account identification number and copy count total. Further, in the set-up mode, the accounts may be sorted by account identification number and examined for individual copy count totals. During the normal mode, the photocopier is enabled when there is a proper machine access code and account identification number and the copy count has not been exceeded. Further, in accordance with the invention, there is provided pulse certification in which both the leading edge and the trailing edge of a photocopier pulse are individually validated.

BRIEF DESCRIPTION OF THE DRAWINGS

FIG. 7 is the copy pulse certification routine performed at block 192 of FIG. 4A;

FIG. 8 is a representation of an access card used in the badge reader shown in FIG. 1.

DESCRIPTION OF THE ILLUSTRATIVE EMBODIMENT

General Description

Figure 1:
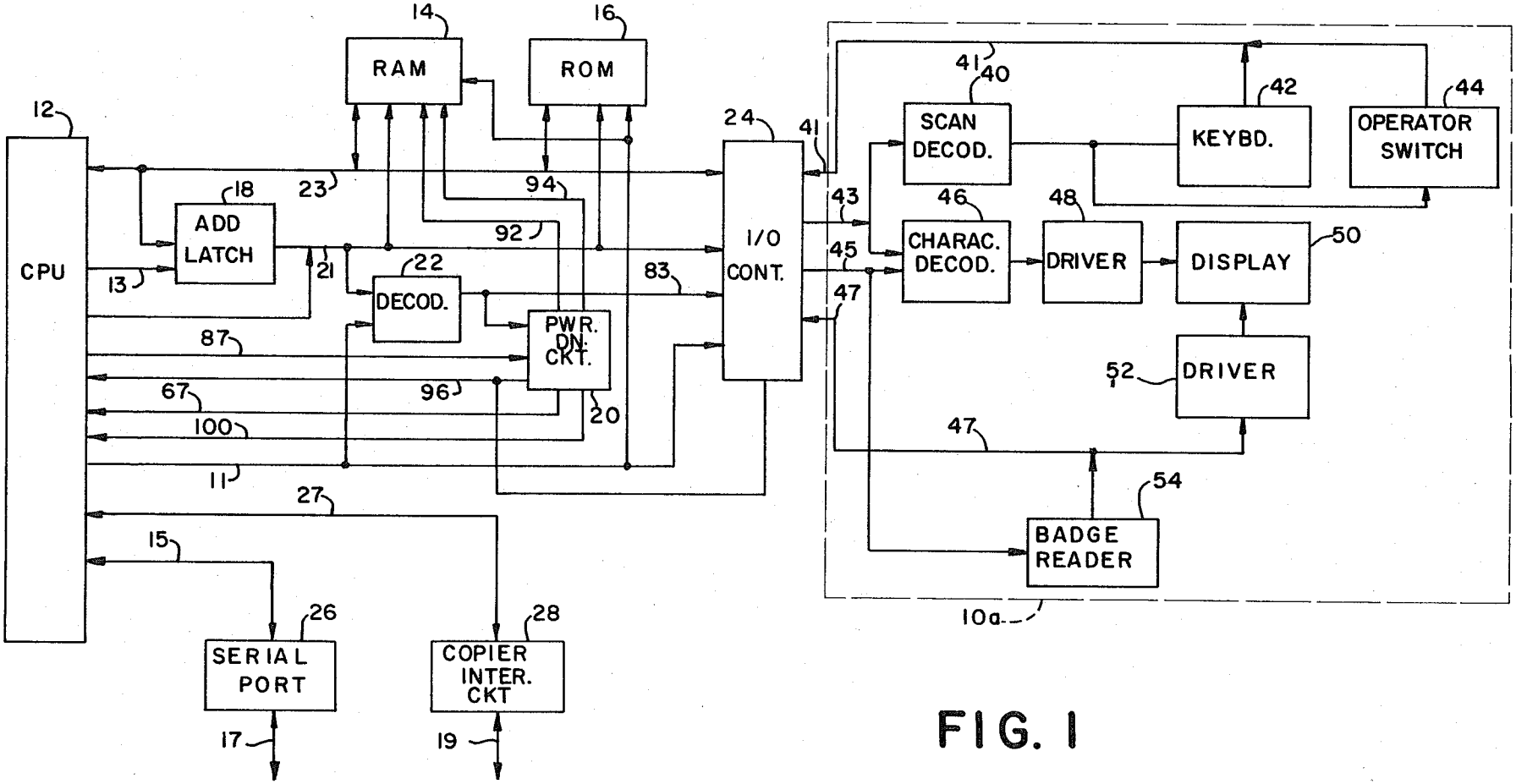
FIG. 1 illustrates in basic block diagram form a photocopy counter and access controller system embodying the invention.

FIG. 1 shows the general configuration of photocopy counter and access controller system 10 comprised of central processor unit (CPU) 12, random access memory (RAM) 14, read only memory (ROM) 16, address latch 18, decoder 22, input/output (I/O) control 24, power down circuit 20, serial port 26, copier interface circuit 28, and I/O subsystem 10*a*. As shown, I/O subsystem 10*a* contains keyboard 42, display 50, user operator switch 44, and badge reader 54. All communications between the I/O subsystem and the CPU are done by way of I/O control 24. I/O subsystem 10*a* also contains keyboard scan decoder and driver 40, character decoder 45, display driver 48, and segment driver 52.

CPU 12 is the "brains" of the system. All program execution is performed within it. While the program is executed within the CPU, it is actually stored in ROM 16 and the CPU fetches each instruction to be executed from ROM 16. Aside from program instructions, there is also data to be manipulated and stored. As in program execution, all data manipulation (for example, add, subtract, compare, etc.) is performed in CPU 12 but stored in and read from RAM 14. Besides program instruction and data, there is also I/O commands and data to be controlled. The CPU reads and writes data and commands from and to I/O subsystem 10*a* by way of I/O control 24.

To allow CPU 12 to access RAM 14, ROM 16, or I/O control 24, the CPU places the first portion of an address in address latch 18 by way of data bus 23, and the second portion of the address is placed directly onto address bus 21. The first portion of the address is latched, when an address latch enable is placed on line 13. After the latching of the first portion of the address, data bus 23 is used for data transmission or reception.

The output of address latch 18 is decoded by decoder 22 in order to select the proper chip in RAM 14 by way of chip select line 92. As shown, the chip selects first go through power down circuit 20 by way of line 83 so that the data in the RAM may be protected when system power is off, or when power is being cycled on or off. If power down circuit 20 senses proper voltage conditions, it will permit chip selection in RAM 14. Once permitted, data may be read from or written to the selected address in RAM 14 by way of data bus 23.

The power down circuit also provides other functions. It contains a battery backup for the RAM and supplies backup power by way of line 94. In addition, it generates several signals to CPU 12. One such signal placed on line 67, is an advanced warning that system power is being shut down. Another signal, placed on line 100, is a warning that the battery power is low and, therefore, the battery should be replaced. Still another signal, placed on line 96, provides a reset command to the CPU whenever power comes on or off and whenever a program malfunction is detected.

Another function of power down circuit 20 is to monitor CPU 12 activity. A signal, placed on line 87, is issued by CPU 12 indicating that the program is running correctly. Failure to issue this signal within a certain amount of time causes a reset command to be issued on line 96 from power down circuit 20. The power down circuit will be discussed in detail later.

Thus, CPU 12 communicates with RAM 14 only after the chip select signal from decoder 22 has been enabled by power down circuit 20. On the other hand, no chip decoding is necessary when CPU 12 communicates with ROM 16. The program ROM is read by CPU 12 by way of data bus 23 and addressed by address bus 21, whenever it has been enabled by control line 11. Since there is only one program ROM, no decoding is necessary.

It will be understood that CPU 12 may be a single chip microcomputer, such as the 8031 microcomputer which has capability of accessing memory and I/O outside of the 8031. The ROM may be a 2716 or 2732 or 2764 chip for storing the program. The RAM consists of 2048 bytes of memory for data storage and may be comprised of 5514 or 6514 components. There are three separate blocks which may be accessed in the data address space. The first two are blocks of CMOS battery backed-up RAM each being a 1,024 byte block. The RAM, however, requires decoding by decoder 22, which may be one chip such as the 74L 00 decoder. Finally, address latch 18 may be a 74LS373 latch for latching address bits from data bus 23.

Also shown in FIG. 1 is copier interface circuit 28 which is the means by which CPU 12 may control an external device, such as a photocopier (not shown). It will be understood that copier interface circuit 28 is of a conventional type and may be similar to the interface circuit disclosed by the Danyl System 80, User Manual which is incorporated herein by reference. The general configuration of badge reader 54 is also disclosed therein. Control signals are sent from CPU 12 to copier interface circuit 28 by way of line 27. Such control signal may be an on/off message from CPU 12 which corresponds to an enable/disable state on line 19 for the photocopier being controlled.

External events, such as copy pulses, also may be interfaced and counted by way of copier interface circuit 28. It will be understood that such copy pulses are generated by photocopying devices for purpose of maintaining counts of the number of photocopies made by such devices. Since the signal characteristics of the copy pulses are different from one photocopier to another, copier interface circuit 28 may accommodate various types of inputs from the photocopy devices. Such inputs, for example. may be 120 VAC, 24 VDC and 5 VDC. The time duration of these pulse inputs may also be of various lengths, for example, they may vary from a few milliseconds to few tenths of seconds. When a copy pulse is detected on line 19 by the copier interface circuit, the pulse is placed on line 27 for further timing and evaluation by CPU 12. The timing and evaluation performed by CPU 12 on the copy pulses will be explained in detail later.

CPU 12 may also communicate with other peripheral devices (not shown) by way of serial port 26. It will be understood that serial port 26 is of a conventional type and may be an RS422 port. Such port permits peripheral devices to control system 10, maintain the system, and pass data to and from the system.

Still referring to FIG. 1, there is shown I/O control 24. CPU 12 communicates with I/O subsystem 10*a* through I/O control 24 by way of keyboard data bus 41, I/O address bus 43, I/O data bus 47 and blanking 45. It will be understood that I/O control 24 may be an 8255A chip having three 8 bit I/O ports that are programmable as input or output. I/O control 24 may communicate with keyboard 42, which may contain, for example, 36 keys for use by a key operator; display 50, which may be a vacuum fluorescent display, for example, having a 16 character 14 segment display; badge reader 54 for user identification; and key operator switch 44 which may be a three position switch for setting the mode of system operation. As will be explained in detail later, three modes of system operation are possible: local mode, normal mode and set-up mode.

I/O address bus 43 provides two functions in I/O subsystem 10*a*. It addresses the display character position which is to be displayed for a certain period of time in display 50 and also selects the keyboard column which is to be examined for the same period of time. With an address on I/O address bus 43, character decoder 46 decodes the character position to be displayed. The character position is then selected in display 50 by way of drivers 48. Once the character position is selected, the segment information present on I/O data bus 47 is displayed in display 50. Drivers 52 contain the buffers/drivers that convert the I/O data bus segment data into proper drive levels for the display.

After a character is displayed for the allotted amount of time, the character decoder is disabled or blanked for a specified amount of time before the next character is displayed. Such disabling is provided by blanking line 45. During this blanking time, segment information is removed from I/O data bus 47 and the same bus is put into an input mode, whereby data may flow into I/O control 24. The data put onto I/O data bus 47 during the blanking time are badge reader 54 data to be read by I/O control 24. The operation of badge reader 54 will be explained later.

When the blanking time is completed by the removal of the blanking signal from line 45, the I/O data bus is returned to the output mode to prepare for display of the next character. After a new display character position is selected by decoder 46, new segment data are placed onto I/O data bus 47 from I/O control 24. In this manner, I/O data bus 47 is a bidirectional bus, providing segment data to the display during non-blanking periods and badge reader data to the CPU during blanking periods.

As already mentioned, I/O address bus 43 selects the keyboard column to be examined during the same time as it selects the display character position. Such selection is done through keyboard scan decoder 40, which decodes the proper keyboard column in keyboard 42. The row information of any key pushed in the selected column being scanned may be read by CPU 12 by way of keyboard data bus 41 and I/O control 24.

It will be noted that operator switch 44 is also scanned, upon being selected by I/O address bus 43 by way of scan decoder 40. When the operator switch is scanned, the switch position selected is read by CPU 12 by way of keyboard data bus 41. Thus, keyboard data bus 41 provides the CPU with information not only of any key pushed in keyboard 42 but also of the switch position selected by operator switch 44.

It will further be noted that keyboard data bus 41 is a unidirectional bus and is only utilized for sending data to the CPU. The I/O data bus, however, is a bidirectional bus which can provide segment data to the display and then provide badge reader data to the CPU. During periods when blanking 45 is inactive, I/O data bus 47 supplies segment data to the display; when blanking 45, however, is active, I/O data bus 47 supplies badge reader data to the CPU.

It will be understood that in order to handle the real time tasks required for the display refresh, keyboard scan, key operator scan, and badge reader scan at a rate which is "flicker" free to the user, the CPU has a timer which interrupts the processor every 500 microseconds. Thus, display character updates and keyboard scans occur at a 500 microsecond rate which is sufficiently fast to provide "flicker" free operation. Furthermore, since CPU software execution times are based on another timer, the display and keyboard scanning updates are independent of software execution.

It will also be understood that character decoder 46 may be comprised of two 4028 and one 74142 decoders, drivers 48, 52 may be of conventional UDN 6118 buffers/drivers, scan decoder 40 may be a 74LS145 decoder, and display 50 may be a conventional FIP1-6A5R.

In operation, the protocol between I/O control 24 and I/O subsystem 10*a* is as follows: If, for example, an address of "0" is placed on I/O address bus 43, keyboard scan decoder 40 causes keyboard 42 to select column "0" of the keyboard. Any keys pushed in column "0" are then presented on keyboard data bus 41. The same address "0" on I/O address bus 43 causes character decoder 46 and drivers 48 to enable or drive character position "0" in display 50. At the same time, I/O data bus 47 presents segment data, comprising the desired character to be displayed to character position "0" of display 50. During this time blanking line 45 is inactive, so that badge reader 54 is disconnected from I/O data bus 47. This condition remains until it is time to go to the next character display position and the next keyboard column position.

Next blanking is asserted by activating blanking line 45. As a result, the display and keyboard are no longer being driven and the I/O address bus is ignored. The badge reader, however, begins to present data to I/O data bus 47 for transmission back to CPU 12. This condition remains until the blanking signal is removed.

Upon removal of the blanking signal, badge reader 54 is disabled. In addition, new address data are presented on I/O address bus 43 to select a new display character position and a new keyboard column to be scanned. Moreover, new segment data are presented on I/O data bus 47 to indicate the character to be displayed in the newly chosen character position. In this manner, I/O data bus 47 is multiplexed between outputting display 50 data and inputting badge reader 54 data.

Figure 3:
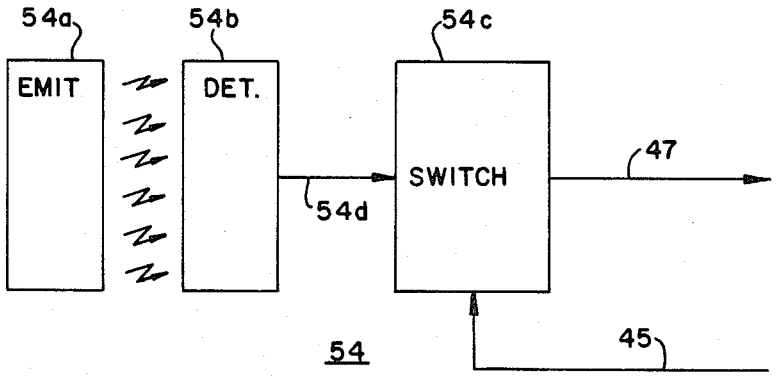
FIG. 3 illustrates in basic block diagram form the badge reader shown in FIG. 1.

The operation of badge reader 54 will now be explained. The badge reader is shown schematically in FIG. 3. It comprises emitters 54*a*, which may be a string of 12 diode emitters, for example. The emitters, which emit radiation in the infrared region, are separated physically on one side of a gap in a surface. On the other side of the gap are located correspondingly opposing detectors 54*b*, which may be 12 in this example. Detectors 54*b* are photo transistors which are sensitive to the infrared emissions. When a user's badge is passed through the gap, holes in the badge are aligned with the emission paths from the emitters to the detectors. Thus, a particular combination of holes in the badge will allow certain emissions from emitters 54*a* to be detected by detectors 54*b*. The detected emissions are then presented to switch 54*c* by way of line 54*d*.

Switch 54c contains, in this example, 12 Schmidt triggers, which may each be triggered by a corresponding photo transistor in detectors 54b. It will be understood that switch 54c may apply the triggered combinations identifying the badge onto I/O data bus 47. As mentioned earlier, such data are not applied until the blanking signal is asserted on line 45.

It must be mentioned at this point that the badge, when inserted inside badge reader 54, has a certain amount of skew tolerance. It is, therefore, possible to insert the badge with slight misalignment, causing the badge reader to send incorrect identification data to CPU 12. The program, however, in CPU 12 checks the validity of the badge reader and insures that the skew tolerance does not create incorrect identification. This skew tolerance routine will be described in detail later.

Power Down Circuit 20

Operation of power down circuit, shown in FIG. 2, will now be described. In general, the power down circuit provides two functions. First, it assures that, when power is applied or turned off, CPU 12 is reset. Also, if for any reason the CPU becomes invalid, a reset is sent to CPU 12 to begin operations from start. Second, it assures data integrity of RAM 14. If system power is lost, battery backup power is supplied the RAM. Also, it prevents CPU 12 from accessing RAM 14, whenever an invalid condition exists or power is being cycled on or off.

In operation, refresh pulse 87 is supplied by CPU 12 every 500 microseconds, while the processor is executing its programs. Such a pulse, it will be understood, is present whenever CPU 12 is performing properly. If for some reason, for example, noise or power disruption, program execution becomes invalid, the refresh pulse would be missing on line 87.

Missing pulse detector and oscillator 76, it will be understood, comprises two mono-stable multivibrators in series forming an astable multivibrator. So long as a refresh pulse is present at the first mono-stable multivibrator, the mono-stable is reset and is started again on its time-out. If, however, a refresh pulse is missing on line 87, the first mono-stable times out its period and will, subsequently, cause the second mono-stable multivibrator to start its timing period. At the end of its period, a reset pulse is placed onto line 75. Such a pulse on line 75 is an indication that the CPU should be reset. The reset pulse on line 75 enters processor reset switch 74 which buffers and drives the reset pulse to the CPU by way of line 96. Thus, every time the refresh pulse is missing from CPU 12, the missing pulse detector and oscillator causes the CPU to be reset and start its program execution from the start.

Figure 2:
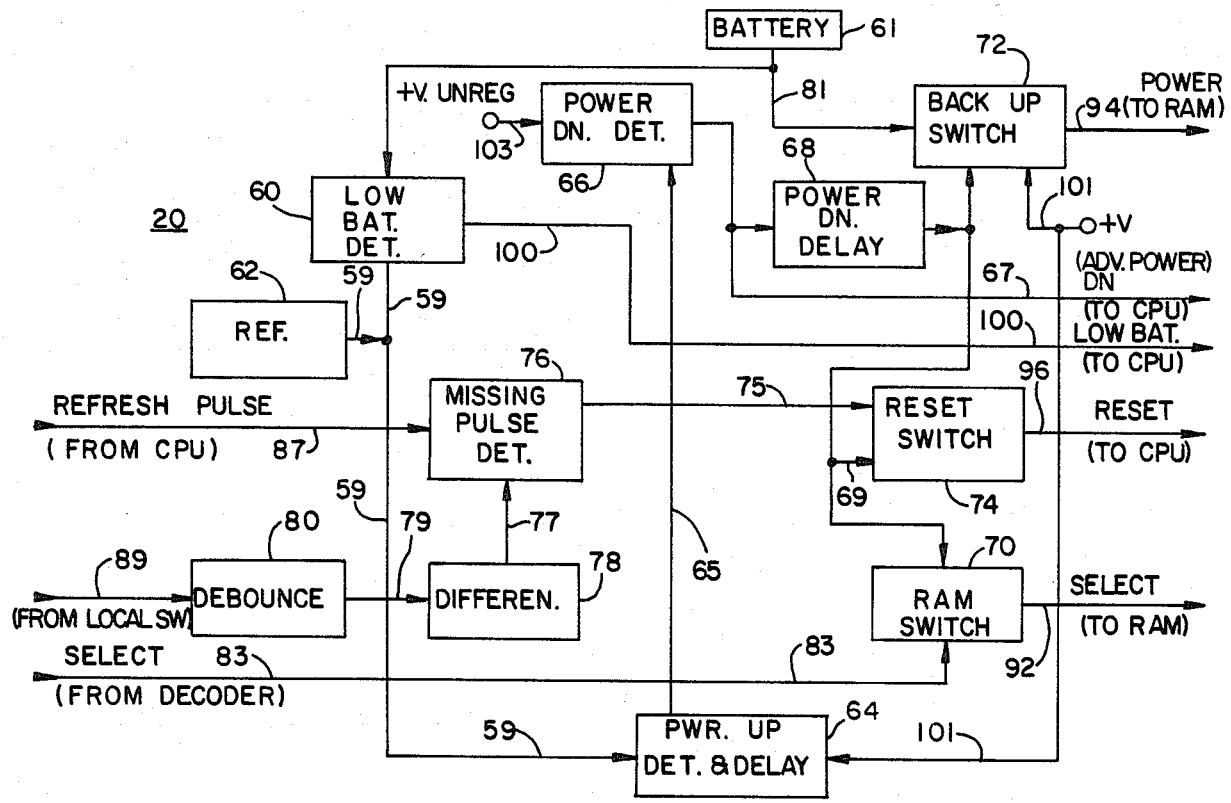
FIG. 2 illustrates in basic block diagram form the power down circuit shown in FIG. 1.

Also shown in FIG. 2 is power up detection and delay circuit 64 which detects the power up phase of system 10. When power is turned on, the system voltage on line 101 begins to rise until it reaches +V. So long as system voltage 101 is less than reference voltage 62, sensed by way of line 59, power up detect and delay circuit 64 produces a reset condition on line 65. The reset condition on line 65 passes through power down detector 66, power down delay 68, and reset switch 74, thereby producing a reset condition on line 96 which then causes CPU 12 to be reset.

When system voltage 101 becomes greater than reference voltage 62, the power up detection and delay circuit 64 begins a delay timer. After the delay has timed-out and, assuming that the system voltage has stayed in a valid state during the delay, circuit 64 removes the reset condition from line 65, thereby causing the reset to be removed from line 96 to the CPU.

Also shown in FIG. 2 is power down detector 66, which monitors the unregulated system voltage (present at the system wall plug) present on line 103. If the system is unplugged from the wall, the voltage on line 103 would begin to decay. Such condition is sensed by power down detector 66, which then sends an advance power notice to CPU 12 by way of line 67. Upon being notified of a power down initiation, CPU 12 stops any new accesses to the RAM. Furthermore, power down delay 68 generates a reset signal onto line 69, which causes CPU 12 to be reset by way of reset switch 74. The same reset signal is also sent to RAM chip selection switch 70, which prevents any further chip selections in the RAM. As shown, switch 70 receives, by way of line 83, RAM chip selection signals from decoder 22 (FIG. 1). Upon being notified of a power down condition by the reset signal on line 69, switch 70 inhibits RAM chip selections from line 83 from reaching the RAM by way of line 92.

The second function provided by power down circuit 20 is to assure that power is always supplied to the RAM in order to insure data integrity. This is accomplished by backup switch 72. Under normal conditions, system power from line 101 is provided to the RAM. During power up or power down conditions, as already mentioned, a reset signal is provided on line 69. This reset signal causes backup switch 72 to switch-in battery power from battery 61 to the RAM by way of backup power line 94. Of course, after system voltage is greater than the battery voltage, RAM power is switched back to system power from line 101.

To assure the integrity of battery 61, low battery detector 60 senses the voltage adequacy of the battery. Thus, the voltage level of battery 61 is compared to reference voltage 62. Whenever the battery voltage falls below the reference voltage, line 100 informs the CPU that the battery voltage is low and the battery should, therefore, be replaced.

Finally, power down circuit 20 provides a means to reset CPU 12 whenever the operator has selected the local mode in order to override the CPU and permit access to the photocopier. Such a situation may arise, for example, if system 10 is not performing properly or CPU 12 is denying access to the photocopier. It will be understood that the local mode is selected by a local switch (not shown) that overrides the CPU and causes a relay in copier interface circuit 28 (FIG. 1) to enable the photocopier.

The closure of the local switch is sensed by debounce by way of line 89. Debounce 80 is a low pass filter which filters out any noise on line 89. This prevents CPU 12 from being reset during false local switch closings. The output of debounce 80 is differentiated by differentiation circuit 78, which provides a pulse on line 77 to be sent to missing pulse detector and oscillator 76. In turn, the missing pulse detector and oscillator provides a single pulse on line 75 to reset CPU 12 by way of reset switch 74. Thus, CPU 12 is reset once, when the local switch is activated by the operator.

It will be understood that debounce 80 may also provide a direct signal (not shown) to CPU 12 by way of line 79. Such a direct signal may notify CPU 12 that system 10 is in the local mode.

CPU Program Description

CPU 12 programs may be divided into three functional parts: a normal mode, a set-up mode, and a local mode. The normal mode controls operations between system 10 and an operator wishing to gain access to the photocopier. The set-up mode controls operations between system 10 and an operator wishing to set-up system 10 for use by others or wishing to verify accounts in the system. Finally, the local mode is used to override system 10 control and permit access to the photocopier regardless of system 10 operation.

An important feature of the set-up mode are various menu items that allow various operations to be performed. One such menu item is the ability to examine each user account and view its current copy status; each account may be randomly or sequentially accessed. Whether an account is permitted or denied access is also shown to the viewer.

Another menu item is the machine access code (MAC) which may be changed by the operator. It will be understood that MAC may be a three-digit code and acts as a security key. Another menu feature is the selection of an upper copy count limit for each account which may be set to zero (denying access) or 99,000, for example.

Yet another menu feature is the mode which allows the remaining copy balance to be displayed in an incrementing or decrementing mode. If an operator selects the incrementing mode, then the gross number of copies made is displayed during copying in an incremental manner (1, 2, 3, 4, etc.). If, however, the decrementing mode is selected, then the balance is displayed in a decreasing balance (1000, 999, 998, etc.).

Another menu item is the sorting feature. The sorting feature permits accounts to be examined in an increasing alpha numeric sequence. This aids the operator in examining the status of accounts in a logical sequence.

The above completes a general description of the set-up mode. A more detailed description of the set-up mode will be described later. A general description of the normal mode will now be given.

In the normal mode, the operator is first notified that system 10 is ready to accept inputs. In order to gain access to the system, the operator must first enter the MAC number by keyboard. Secondly, he must enter his account number correctly by keyboard or by badge. Assuming that the MAC number and the account number are correct, system 10 will next check the account number's copy balance. If the copy balance has not reached its maximum, the photocopier is unlocked and the remaining copy balance is displayed, incrementally or decrementally. If the operator exceeds his copy allotment during the transaction, the system permits the photocopier to complete the transaction. This prevents jamming of the photocopier. Once the transaction is completed, system 10 does lock out the operator and effectively terminates his activity.

A detailed flow diagram of the system 10 program is shown in FIGS. 4, 4*a*, 5, 5*a* and 5*b*. The program will now be described serially. Beginning with START 140, the program initializes all functions and checks the battery (block 142). If the battery is OK (block 146), READY is displayed to the operator (block 150); if the battery is low, Low BATTERY is displayed (block 148).

At this juncture, as shown, the program waits for one of three things to occur: a key on the keyboard to be pressed (block 152); a copy pulse from the copier interface circuit to be received (block 154); or the maintenance or set-up switch to be activated (block 156). If the START key is pressed (block 350), MAC validity is checked (block 166); if the START key is not pressed, the program checks whether the CANCEL key has been pressed (block 352). If the CANCEL key has been pressed, then the program loops back to block 146 indicating that all previous key inputs are to be ignored. If the CANCEL key has not been pressed, the program checks how many keys have been pressed (block 354). If more than the maximum number of keys have been pressed, for example 13 keys, then TOO MANY is displayed on the display for two seconds (block 360) and the program loops back to block 146. If the key limit has not been reached, then the keys entered thus far are displayed (block 356). The program then waits for the next key to be pressed (block 358) and then loops back to block 350.

Returning to block 350, if the START key has been pressed, MAC validity is checked (block 166). MAC, as already mentioned, is a machine access code and, for example, may be comprised of three digits. If the MAC digits pressed are incorrect, then BAD MAC is displayed for 2 seconds on display 50 (block 168) and the program loops back to block 146. If the MAC is correct, then the program checks whether the entered account number (which may be, for example, a 2-digit code entered by the operator) is in memory (block 362). If it is not, then BAD ACCOUNT is displayed for 2 seconds (block 364) and the program loops back to block 146. If it is in memory, then the account is checked to see whether access has been denied (block 170). If it has, DENIED is displayed for 2 seconds (block 172) indicating that access has been denied to that account and the program loops back to block 146. If, however, access is permitted, the program checks whether the account has exceeded its copying limit (block 174). Assuming that the limit has been exceeded, LIMIT is displayed on display 50 (block 176) and the program loops back to block 146. If the limit has not been exceeded, the copier is enabled by way of the copier interface (block 180) and the program proceeds to block 182 (FIG. 4*a*).

Figure 4:
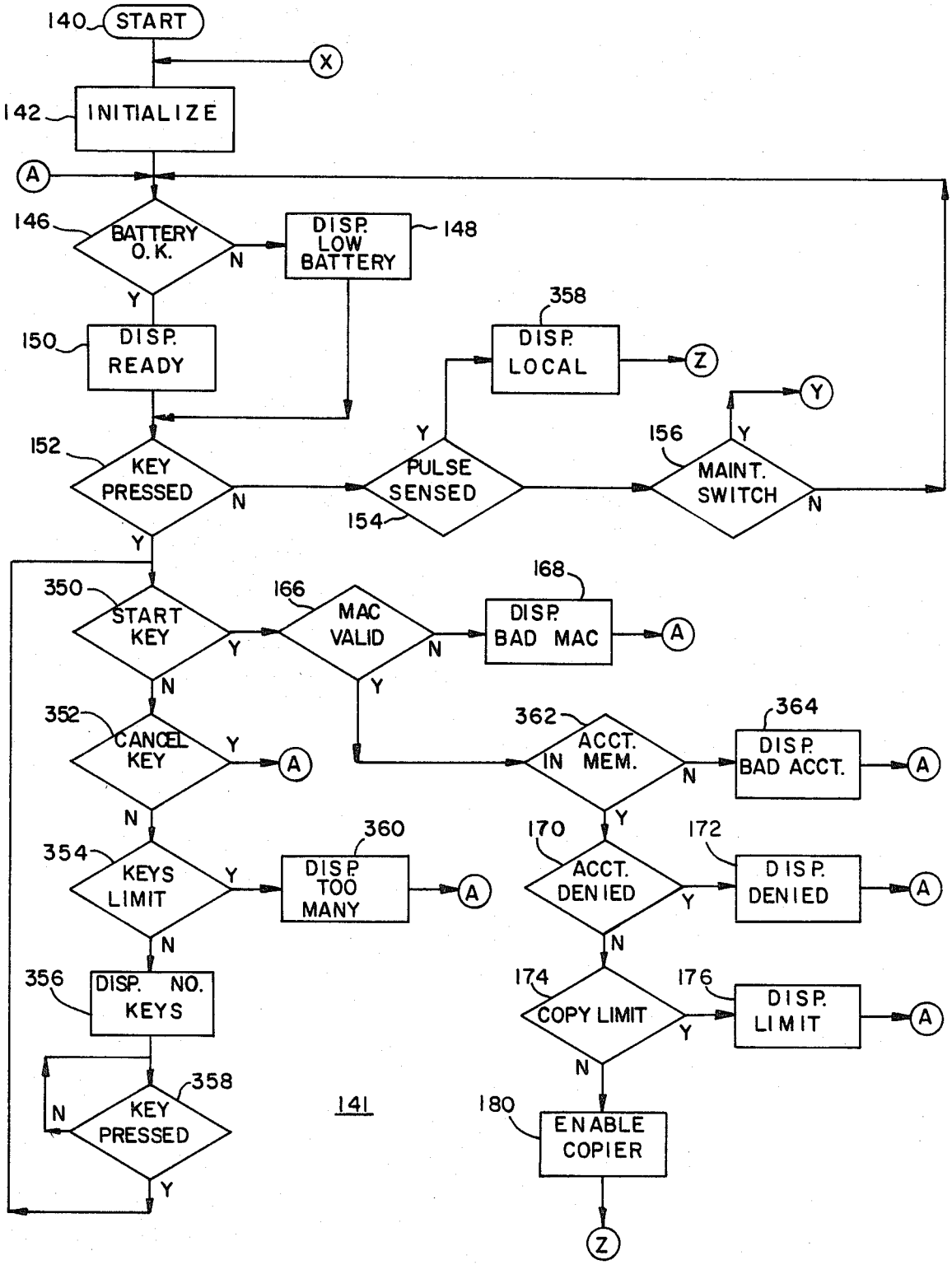
FIGS. 4–4A taken together form a functional flow diagram of the program performed by the system shown in FIG. 1.

Still referring to FIG. 4, if the set-up switch is selected (block 156), the program loops to block 280 (FIG. 5), which will be described later. If a key has not been pressed on the keyboard (block 152) and a copy pulse has been received (block 154), then LOCAL is displayed (block 358) indicating that the local mode has been selected. In addition, in order to keep track of the number of copies made in the local mode, the program sets the account code to 100, for example, and maintains count of the copies made, as will be explained later.

Figure 4A:
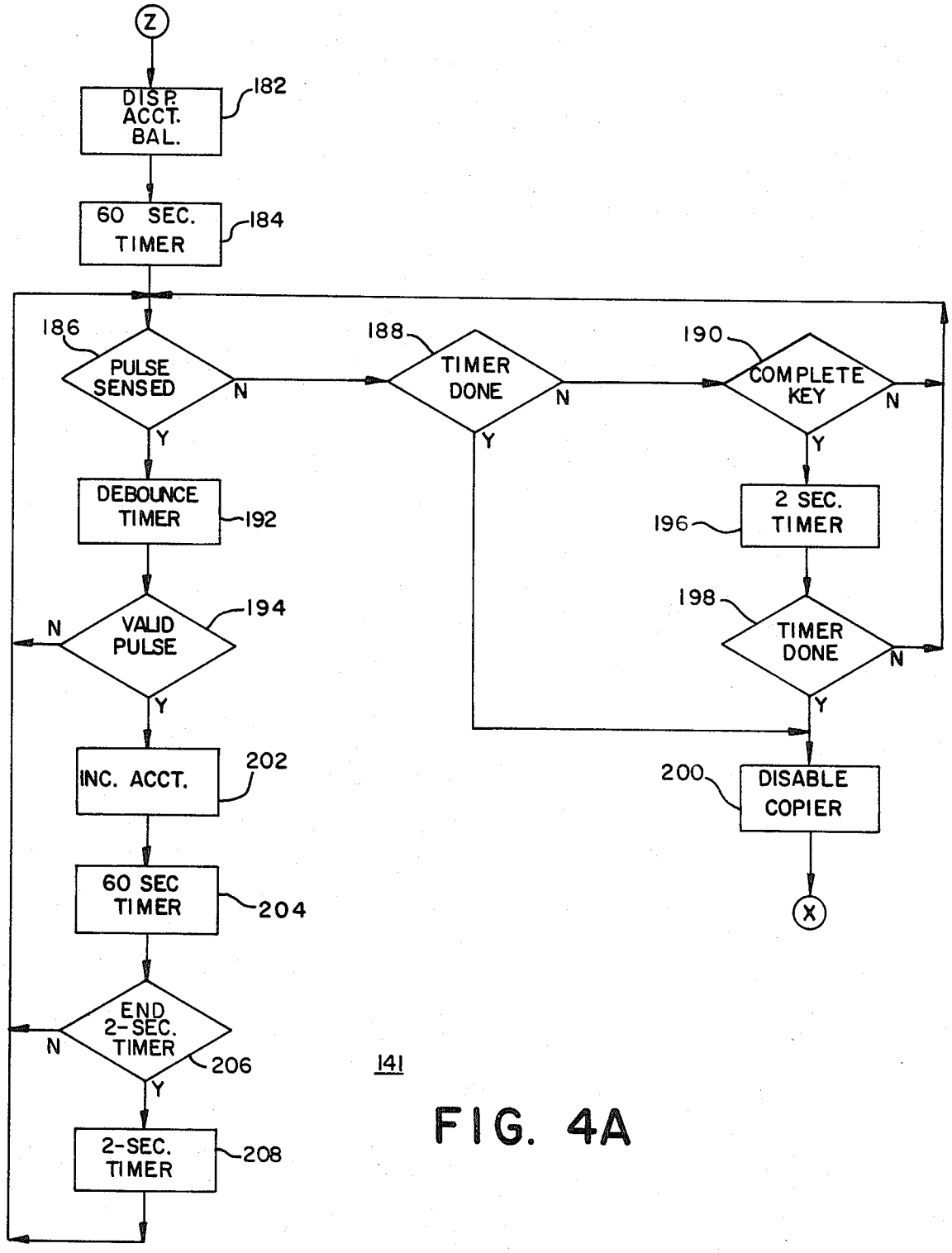

The method in which the number of copies made is counted is shown in FIG. 4*a*. As shown, the program displays the account's balance according to the mode selected (block 182). If the incrementing mode is selected, the gross number of copies made to date is displayed; if the decrementing mode is selected, only the balance remaining is displayed. The program also activates a 60-second timer (block 184) so that if no activity is present for 60 seconds, the copier is disabled.

Block 186 checks whether a copy pulse has been received. If not received within 60 seconds (block 188), the copier is disabled (block 200) and the program loops back to START 140. If the 60-second timer has not yet timed-out (block 188), the program checks whether the COMPLETE key has been pressed (block 190). If not pressed, the program loops back to check whether a copy pulse has been received (block 186); if COMPLETE has been pressed, a 2-second timer is started (block 196). Upon completion of the 2 seconds (checked by block 198), the copier is disabled and the program loops back to START 140.

Referring back to block 186, if a copy pulse has been received, a copy pulse debounce timer is started (block 192). The debounce timer monitors whether the copy pulse is present for some minimum period. If present for the correct minimum period, the copy pulse is assumed to be valid; otherwise, the copy pulse is assumed to be noise and is ignored. If the copy pulse is valid (block 194), the selected account register is incremented (block 202). The 60-seconds timer is restarted (block 204) and, if the 2-second timer is running (block 206), the 2-second timer is also restarted (block 208). The program then loops back to wait for the next copy pulse. This loop continues as long as copy pulses are received. If no copy pulses are received for the timed period, the copier is disabled (block 200).

Figure 5:
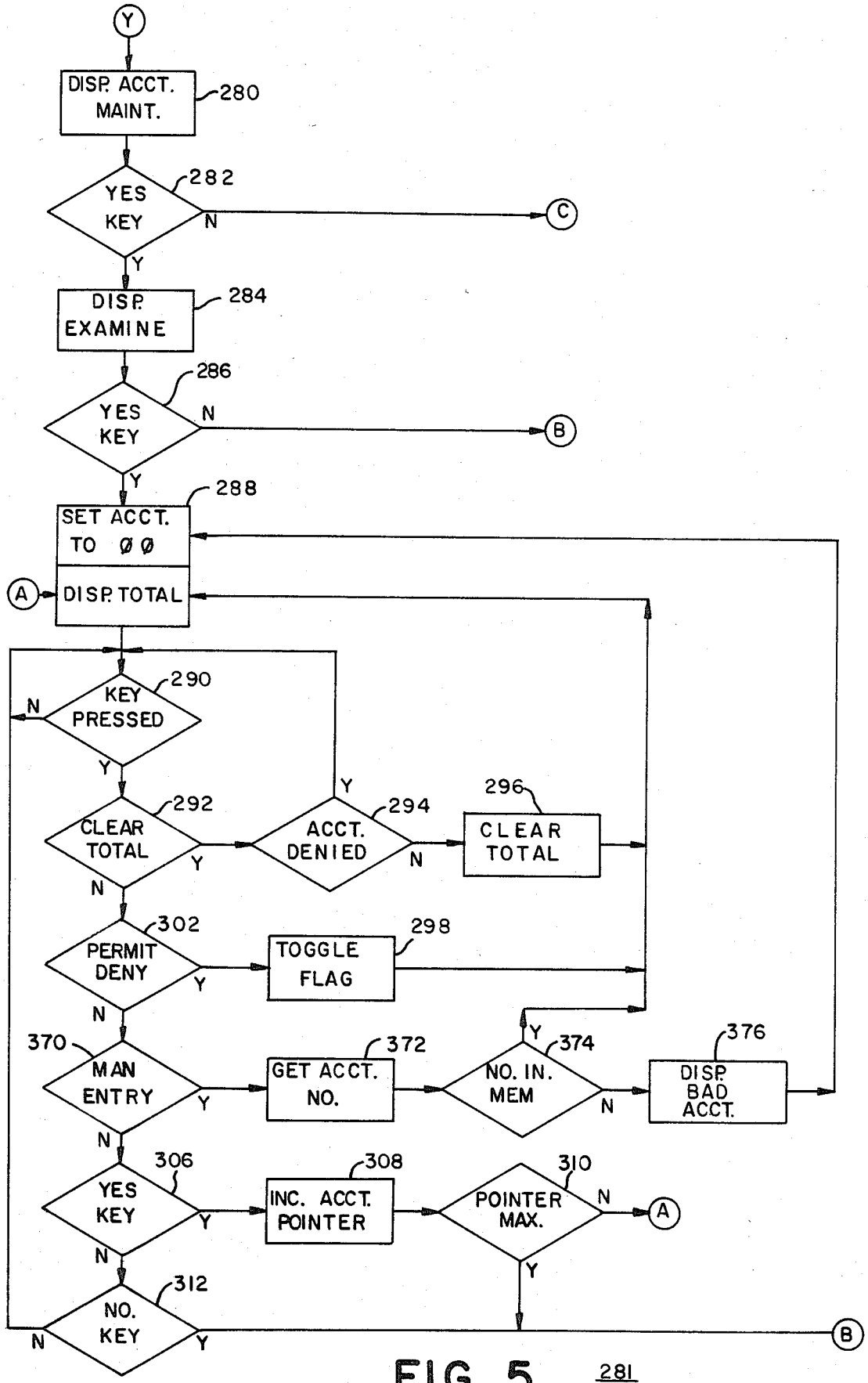
FIGS. 5, 5A and 5B taken together form a functional flow diagram of the set-up mode performed by the system shown in FIG. 1.

If the set-up mode has been selected (block 156, FIG. 4), the program jumps to block 280, shown in FIG. 5. At this juncture, "ACCOUNT MAINT?" is displayed. The program then checks whether a YES or NO key is pressed by the operator (block 282). If NO is pressed, the program jumps to the initialization handler (block 210, FIG. 5*a*); if YES is pressed, "EXAMINE?" is displayed on display 50 (block 284). The program then again checks whether a YES/NO key is pressed (block 286). If NO is pressed, the program jumps to the delete handler (block 378, FIG. 5*a*); if YES is pressed, the account pointer is set to zero, which corresponds to the first account location in RAM 14 (block 288). At this juncture, the account number and its copy total are displayed on display 50.

At this point, one of five keys may be pressed on the keyboard: the CLEAR TOTAL key, PERMIT/DENY key, MANUAL ENTRY key, YES key, or NO key. If CLEAR TOTAL IS PRESSED (block 292), the program checks whether the account is denied (block 294). If the account is denied, the program loops back to block 290 to await the pressing of another key. If the account is not denied, the account's total register in RAM 14 is cleared (block 296) and control passes back to block 288, which updates the copy total to zero.

If the PERMIT/DENY key is pressed (block 302), a permit/deny flag is toggled (block 298; if previously it has been "1," upon being toggled it becomes "0," or vice versa. It will be understood that permitting or denying is a method to selectively allow or disallow someone's use of his account number. If an account is permitted, then an operator using the copier is only checked for total copy limit. If an account is denied, however, although a valid code is entered, the operator is denied access to the copier.

If the MANUAL ENTRY key is pressed (block 370), the program waits for the operator to key in the account number of interest (block 372). A check is then made to determine whether the account number is in the RAM (block 374). If it is in memory, the program displays the account and copy total (block 288). If it is not in memory, BAD ACCOUNT is displayed for 2 seconds (block 376) and the account pointer is set to zero (block 288).

If the YES key is pressed (block 306), the account pointer is incremented sequentially (block 308) so that the operator may view the next account's copy total. The program then checks whether the pointer has reached its maximum, for example 101 (block 310). If the maximum account has not been reached, the program displays that account and its copy total (block 288). If the maximum has been reached, the program loops to the delete handler (block 378, FIG. 5*a*).

Figure 5A:
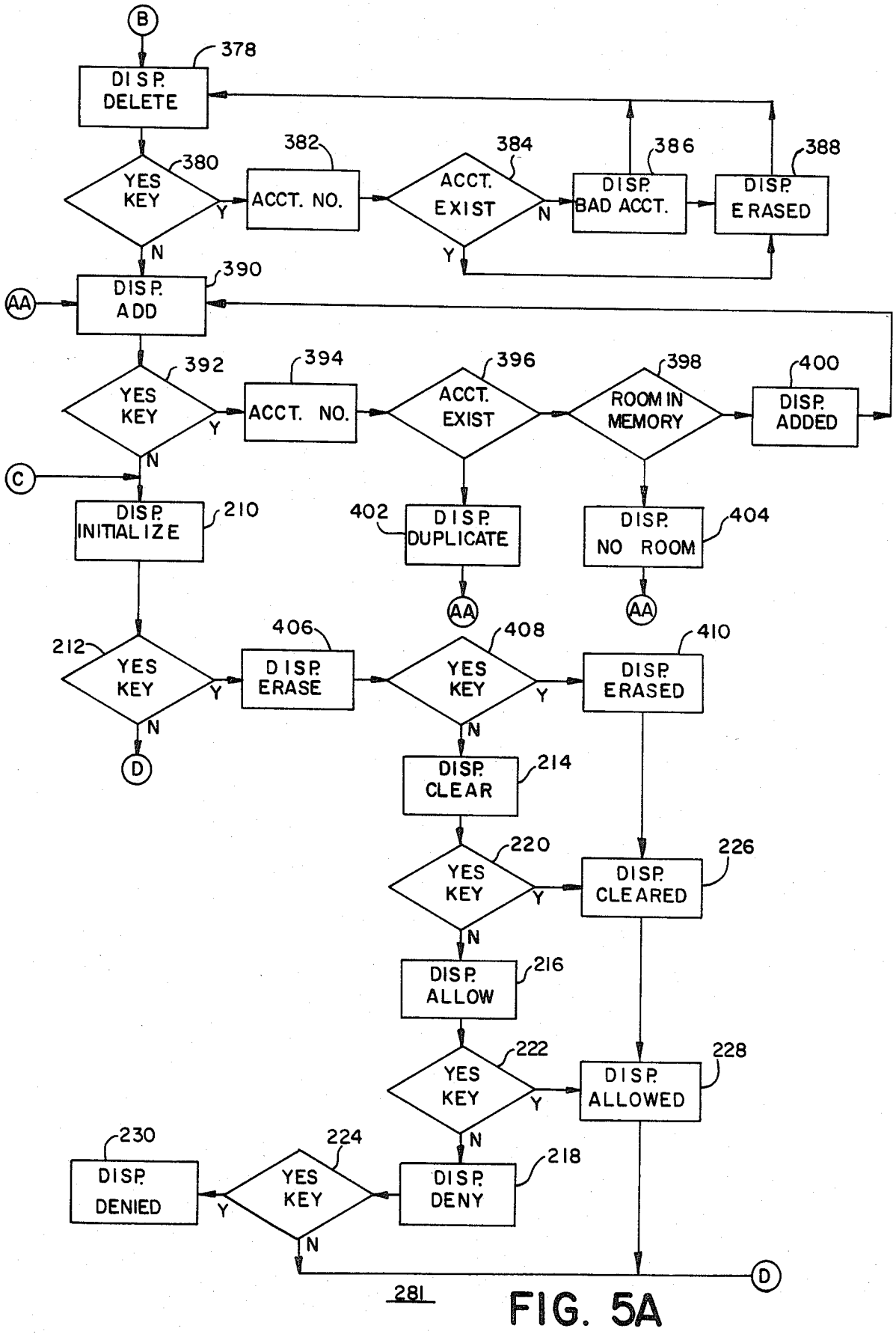

Finally, if the NO key is pressed (block 312), the program loops directly to the delete handler (block 378, FIG. 5*a*). "DELETE?" is then displayed on display 50. The program then waits for the YES or NO key to be pressed (block 380). If YES is pressed, the program waits for the operator to key in the account number to be deleted (block 382). A check is then made of whether the account exists (block 384). If it exists, the account is deleted and ERASED is displayed for 2 seconds (block 388). If it does not exist, however, BAD ACCOUNT is displayed for 2 seconds (block 386).

If the NO key is pressed (block 380), "ADD?" is displayed (block 390). The program then waits for the operator to press either YES or NO (block 392). If YES is pressed, the program waits for the operator to key in the account number to be added (block 394). A check is made to determine whether the account already exists (block 396). If already in existence, DUPLICATE is displayed for 2 seconds (block 402); if not a duplicate, another check is made to determine if there is room in memory to add the account (block 398). If there is no room, NO ROOM is displayed for 2 seconds (block 404). If there is room, however, the account is added and ADDED is displayed for 2 seconds (block 400). The program then loops back to block 390.

If the NO key is pressed (block 392), "INITIALIZE?" is displayed (block 210). Again, the program waits for a YES or NO key to be pressed (block 212). If NO is pressed, the program jumps to the limit handler (block 240, FIG. 5*b*). If YES is pressed, "ERASE?" is displayed (block 406). Again, the program waits for a YES or NO key to be pressed (block 408). If YES is pressed, the memory in the RAM is erased and ERASED is displayed for 2 seconds (block 410).

If NO is pressed in block 408, the message "CLEAR?" is displayed (block 214). The program then waits for a YES or NO key (block 220). If YES is pressed, the memory is cleared and the display shows CLEARED for 2 seconds (block 226).

If NO is pressed in block 220, the message "ALLOW?" is displayed (block 216). A YES key subsequently pressed (block 222) notifies the program to allow access to all accounts and display ALLOWED for 2 seconds (block 228).

If NO is pressed in block 222, the message "DENY?" is displayed (block 218). The program then waits for a YES or NO key to be pressed (block 224). If YES is pressed, access to all accounts is denied and DENIED is displayed for 2 seconds (block 230). If NO is pressed in block 224, the program jumps to the limit handler (block 240, FIG. 5B).

Figure 5B:
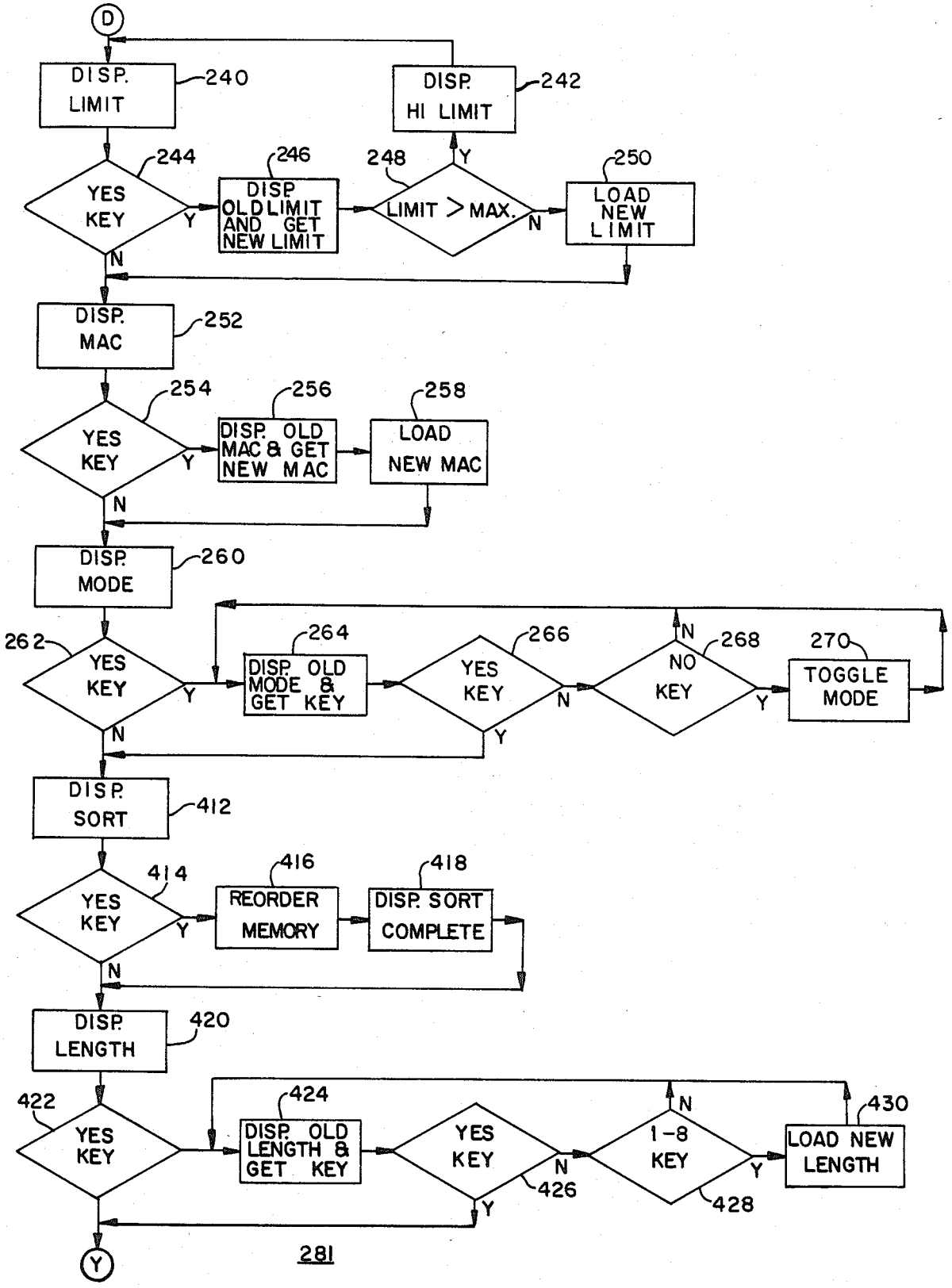

Referring now to FIG. 5B, there shown is the limit handler, wherein "LIMIT?" is displayed on the display (block 240). If YES is then pressed (block 244, the current copy limit is displayed and the program waits for the new copy count limit to be keyed in (block 246). A check is then made to determine whether the new copy limit exceeds the allowed maximum, for example 99,000 copies (block 248). If it does, HI LIMIT is displayed for 2 seconds (block 242). If it does not, the new copy limit is loaded into memory (block 250) and the program loops down to the MAC handler (block 252).

Referring to block 252, the program displays "MAC?" on the display. If YES is subsequently pressed (block 254), the current MAC number is displayed and the program waits for a new MAC to be keyed in (block 256). The new MAC is then loaded into memory (block 258), and the program loops down to the mode handler (block 260).

As already mentioned, the mode handler permits copy counts to be displayed in an incrementing or decrementing manner. The mode handler begins with the display showing "MODE?" (block 260). If the YES key is then pressed (block 262), the current mode (incrementing or decrementing) is displayed and the program waits for a YES or NO key (block 264). If YES is pressed (block 266), the program jumps down to block 412; if NO is pressed (block 268), then the mode is toggled (block 270) and the program loops back to display the new mode. In this manner, the mode can be toggled to be incrementing or decrementing.

The sort handler begins in block 412 wherein "SORT?" is displayed on display 50. If YES is subsequently pressed (block 414), the accounts in memory are reordered into ascending alpha numeric order (block 416) and SORT COMPLETE is displayed for 2 seconds (block 418). The program then loops down to the length handler (block 420).

The message "LENGTH?" is then displayed on the display (block 420). If NO is pressed (block 422), control passes back to the beginning of the maintenance or set-up routine (block 280). If YES is pressed, the current length is displayed and the new length may now be entered (block 424). The new length may be, for example, between 1 and 8 inclusive, and is used to format display 50. If the YES key is pressed (block 426), the current length is saved and control passes to the beginning of the set-up routine (block 280). If not, a check is made to determine whether the 1–8 key is pressed (block 428). If it is these keys, the new length is loaded into memory; otherwise, it is ignored. The new length is then displayed (block 424) and if YES is pressed (block 426), control passes to the beginning of the set-up routine.

Badge Operation

Figure 6:
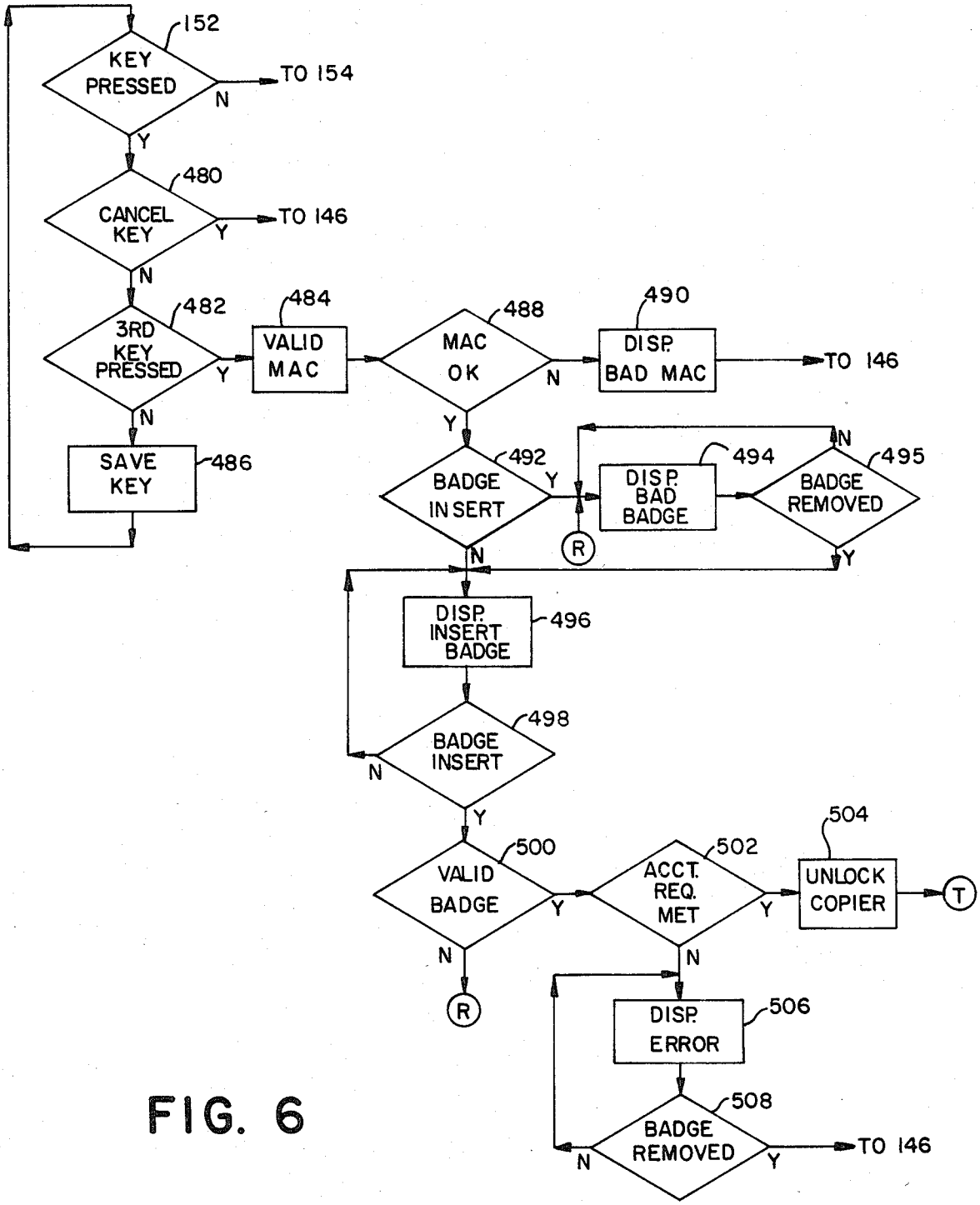
FIG. 6–6A taken together form a functional flow diagram of the badge operation performed by the system shown in FIG. 1.

The badge operation routine, shown in FIGS. 6, 6A and 6B, will now be described. It will be understood that the badge operation routine is part of the program performed by CPU 12. Referring to FIG. 6, there is shown decision block 152 which, it will be recalled, has been discussed earlier in FIG. 4. It is at this junction that the badge operation routine begins.

The routine checks whether the CANCEL key has been pressed (block 480). If it has been pressed, the program jumps to block 146, shown in FIG. 4. If it has not been pressed, the program checks whether a third key has been entered (block 482). Until a third key is entered, the program simply saves the entered key and displays it on display 50 (block 486). Upon entry of a third key, the program begins validation of the MAC number (block 484). It will be understood that in this example three keys must be entered, as they represent the three-digit code of the MAC. If the MAC number is not valid (block 488), the message BAD MAC is displayed (block 490) and the program jumps to block 146, shown in FIG. 4.

If the MAC number is valid, the program determines whether the badge is already inserted in the badge reader (block 492). If it has already been inserted, BAD BADGE is displayed (block 494) and the program waits until the badge is removed (block 495).

Once the badge is removed, or if the badge has never been inserted, the message INSERT BADGE is displayed (block 496). The program then waits for the badge to be inserted (block 498). After the badge is inserted, a validity check is made on the badge (block 500). The badge validity check will be described in detail later. If the badge is invalid, BAD BADGE is displayed (block 494); if a valid badge has been inserted, however, the program also checks whether the account requirements have been met (block 502). If the account requirements have not been met, an error message is displayed (block 506), as has been described earlier. The program then waits for the badge to be removed (block 508) and loops back to block 146, shown in FIG. 4. If the account requirements have been met, the copier is unlocked by way of the copier (block 504).

Figure 6A:
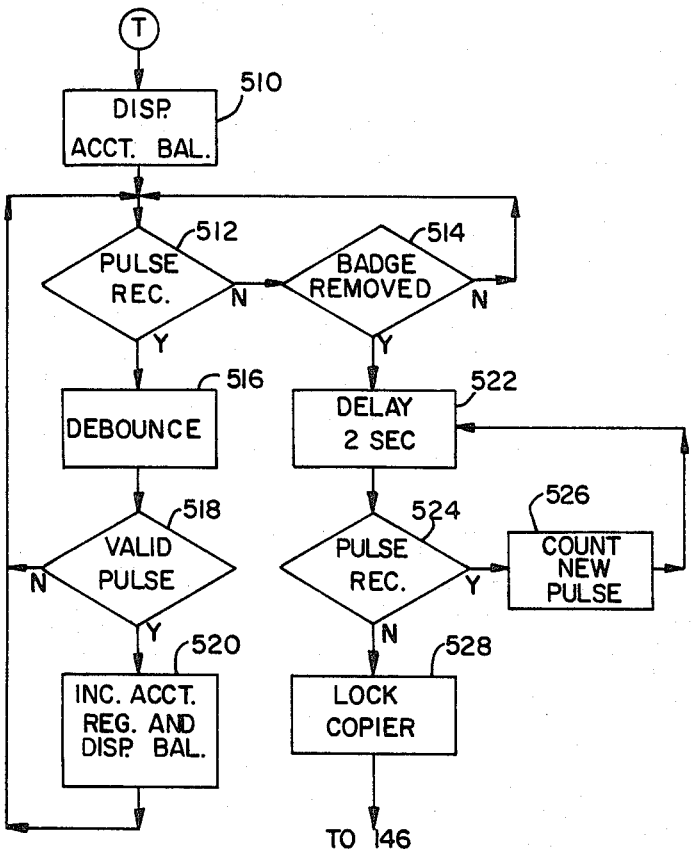

Referring next to FIG. 6A, after the copier is enabled, the account balance is displayed (block 510), as has already been described. If a copy pulse is received next, the copy pulse is debounced and checked for its validity (blocks 512, 516, 518). If a valid copy pulse, the account register is incremented and the new balance is displayed (block 520). The program then waits for the next copy pulse to arrive.

If a valid copy pulse has not been received, the program checks whether the badge has been removed (block 514). If the badge has not been removed, the program waits for the next copy pulse to arrive. If the badge has been removed, a two-second delay is started to check for remaining copies (block 522). The two-second delay insures that all copies made are counted by system 10, although the badge has been removed. Thus, as long as new copy pulses are received, the new pulses are counted by the program (blocks 524 and 526). If no new copy pulses are received within two seconds, the copier is disabled (block 528) and the program jumps to block 146, shown in FIG. 4.

Referring now to the badge validity check (block 500), it must be first recalled that a badge when inserted in badge reader 54 has a certain amount of skew tolerance. The function of the badge validity routine is, therefore, to check for proper badge identification, taking into consideration the skew tolerance of the badge.

One example of a badge access card is shown in FIG. 8. As shown, badge 700 has six rectangular holes, 710 through 720. Each horizontal pair of holes represents a single character. For example, the three pairs shown represent three characters: pair 710, 712 represents "2"; pair 714, 716 represents "0"; and pair 718, 720 also represents "0." Badge 700 may be inserted into badge reader 54 in a downwardly direction shown by arrows 722. Consequently, upon being inserted in the slot, if no skew is present, the badge reader will first detect holes 718, 720; next it will detect holes 714, 716; and finally it will detect holes 710, 712.

However, if badge 700 is inserted with a skew, it may be possible to detect three holes at once; for example, it may detect two holes in one row and another hole above the two lower holes. In FIG. 8, if the badge is tilted slightly, holes 714, 716 and 712 may be read in one row.

Therefore, the badge validity routine must check the skew tolerance. In essence, the routine attempts to pair holes, although they were identified separately by the badge reader. Once two holes are paired, they are identified as one character. When a third hole then appears, the routine identifies that third hole as belonging to a new character and throws away the previously paired holes.

Figure 6B:
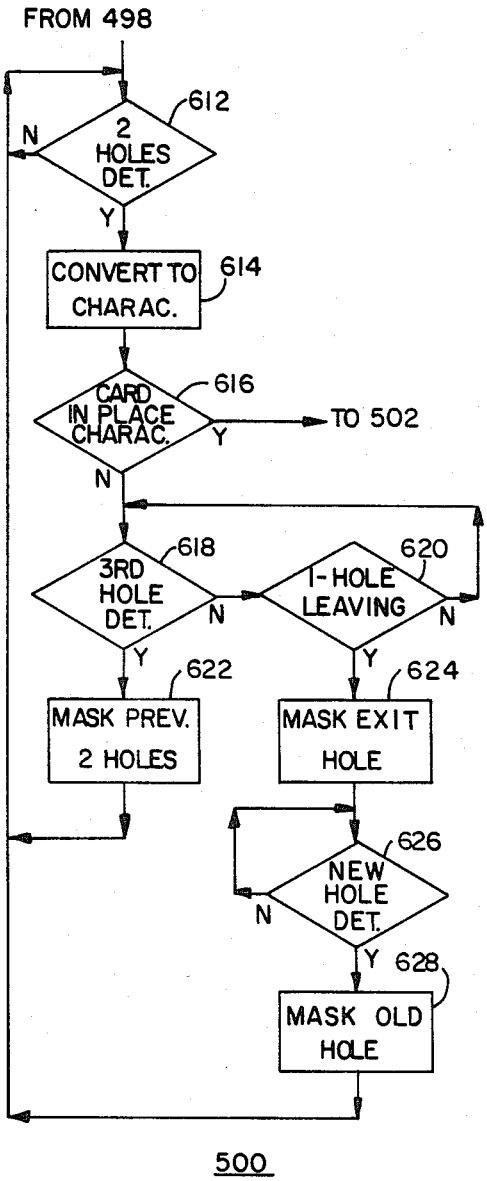
FIG. 6B is the skew tolerance routine performed at block 500 of FIG. 6.

Referring now to FIG. 6B, there is shown the badge validity routine 500, which may also be referred to as the skew tolerance routine. The routine first checks whether 2 holes have been detected (block 612). Once 2 holes are detected, they are decoded into a badge character and loaded into memory (block 614). The routine next checks whether this is a special character which is utilized to denote the last character on the badge (block 616). If it is the last character, the routine exits to block 502. If it is not the last character, the routine waits for a third hole to be detected which may represent the first half of the next character (block 618). When the third hole is detected, the previous 2 holes are masked or erased since they have already been stored in memory (block 622), and the routine loops back to block 612 to wait for the next 2 holes.

If a third hole is not detected, the routine determines whether one of the previous 2 holes is exiting, i.e., is moving downwardly past the emitters of the badge reader (block 620). If it is not exiting, the program simply waits for the third hole to be detected (block 618). If, however, one hole is determined to be exiting, the program erases the exiting hole (block 624) and then waits for a new hole to be detected (block 626). As soon as a new hole is detected, the previous hole is also erased (block 628) and the program again starts to anticipate 2 holes (block 628). Finally, when the last 2 holes are received (block 616), the program exits to block 502. In this manner, the accuracy of the badge reader is increased.

Copy Pulse Certification

As mentioned earlier, copy pulses received from a copier vary in amplitude and duration from one manufacturer to another. After being detected by the copier interface circuit (FIG. 1), the copy pulse is filtered to eliminate any ringing on the pulse and then is sent to CPU 12 for further timing and evaluation.

As will now be explained, system 10 samples the incoming copy pulse to determine whether it is a valid copy pulse and not merely noise. Furthermore, system 10 is capable of sampling and evaluating any pulse, regardless of pulse width. For example, it may sample a copy pulse of only a few milliseconds and also a copy pulse of several seconds without requiring any physical adjustments to system 10.

Referring now to FIG. 7, there shown is an expansion of block 192 (FIG. 4A), which is the copy pulse debounce logic. Upon detection of a pulse (block 450), timer is started to time-out 15 milliseconds (block 452). A check is then made to determine whether the pulse is still present, i.e., is a level "1" (block 454). If the pulse is no longer present, it is assumed that the copy pulse was only noise and the program jumps back to wait for the next pulse. If the pulse is still high and the timer has timed out the 15 milliseconds (block 456), a determination is made that the copy pulse has a valid leading edge (block 458).

Another check is made to determine whether the copy pulse is still a level "1" (block 460). As long as the pulse remains high, nothing further is done. As soon as the pulse goes low or becomes a level "0," a second 15 milliseconds timer is started (block 462). A check is then made to determine whether the pulse has remained low for 15 milliseconds (blocks 464, 466). If the pulse has not remained low within that duration, the program assumes that it is still high and the temporary low was only noise. If, however, the pulse remains low for at least 15 milliseconds, a determination is made that a valid copy pulse is present (block 468).

In this manner, the copy pulse is certified. The pulse must be present for at least 15 milliseconds and then must disappear for at least 15 milliseconds. It will be understood that the 15 milliseconds described herein is only an example and may be any reasonable period. Of course, the leading edge timer may also be a different period than the trailing edge timer.

In power down circuit 20, the following components have been used for the operation described:

| Ref. Char. | Components |
|---|---|
| 60,64 | LM339 |
| 66 | ICL8212 |
| 68 | PN5142 |
| 72 | PN5142, MPS5172, 4 × 4.7 kilohm |
| 74 | MPS5172 |
| 76 | 74LS123(2x) |
| 78 | LM339, 4.7 kilohm(2x), .1 microfarad |

The program for executing the flow diagram of FIGS. 4–7 is stored in ROM 16 and is called upon as necessary by CPU 12. A copy of the program listing is enclosed.

What is claimed is:

1. In an event counter and access controller system having an internal central processing unit, memory storage unit, a subsystem including an operator's display and keyboard, a device for outputting an event pulse having a leading edge and a trailing edge, and pulse certification means for producing a valid enable pulse in response to said edges; means for setting up the system in a set-up mode prior to a normal mode of operation by the an operator comprising:

first selecting means for selecting a machine access code having at least a one-digit code for a first verification of the access of the operator, second selecting means for selecting in said memory storage unit an individual identification of each of a plurality of accounts each corresponding to a different user, each account having a corresponding account identification number and event count total, sorting and selecting means for sorting and selecting one of said accounts by account identification number and examining said event count total associated with said one account, means for incrementing and decrementing said event count total responsive to said valid enable pulse, and means for enabling event pulse device during the normal mode when the first and second selecting means verify a proper machine access code and account identification number and the event count is not exceeded.

2. The system of claim 1 in which said setting up means includes toggling means for setting a flag in said memory storage unit permitting or denying access to any account.

3. The system of claim 2 wherein said setting up means includes event count balance selection means for selecting a count-up balance or a count-down balance during said normal mode of operation.

4. The system of claim 3 wherein said count-up balance may exceed said event count total or said count-down balance may be less than zero during said normal mode of operation for preventing photocopier jams.

5. The system of claim 4 wherein there is provided an operator's switch for selecting one mode among said set-up mode, normal mode or a local mode of operation, said local mode of operation for overriding said enabling means to automatically enable said counter.

6. The system of claim 1 wherein said device for outputting an event pulse and said pulse certification means include:

means for detecting the leading and trailing edges of the event pulse, means for producing a valid leading edge signal if the event pulse is still high at the end of a first predetermined time interval after the leading edge is detected, and means for producing a valid enable pulse in response to said valid leading edge signal if the event pulse is low at the end of a second predetermined time duration starting at the trailing edge of the event pulse.

7. The system of claim 1 wherein said subsystem further includes a badge reader and a switch comprising:

control means for interfacing said central processing unit with said subsystem, an address bus, scanning means coupled between said control means and said keyboard and switch by way of said address bus for addressing locations in said keyboard and said switch for transmission of data from said addressed locations, a first data bus coupled to said control means for transmitting said data from said addressed locations to said control means, and a second data bus coupled to said control means for transmitting data from said badge reader to said control means during a first interval and from said central processing unit to said display during a second time interval.

8. The system of claim 1 wherein there is provided refresh means coupled to said central processing unit for refreshing said central processing unit comprising:

means within said central processing unit for producing a series of pulses, pulse detection means for detecting each of said pulses, reset means for initializing said central processing unit after a predetermined time duration without detection of any of said pulses, thereby indicating a missing pulse.

9. The system of claim 1 wherein there is provided a badge reader coupled to said processing unit for receiving badges, each badge having a plurality of groups of holes, each group of holes having two horizontally positioned holes denoting a single character comprising:

detecting means for detecting said groups of holes, decoding means for decoding said groups of holes into characters, and means for determining whether the position of the received badge is within a predetermined skew tolerance.

10. The event counter and access controller of claim 1 wherein said selecting means functions under operator control to select one of a plurality of operator-accessible identification indicative of an account corresponding to a user who is not an operator.

* * * * *